United States Patent [19]

Luydkx et al.

[11] Patent Number: 5,021,086

[45] Date of Patent: Jun. 4, 1991

[54] IRON DESULFURIZATION ADDITIVE AND METHOD FOR INTRODUCTION INTO HOT METAL

[75] Inventors: Leon A. Luydkx, Rio Rancho, N. Mex.; Joseph R. Jackman, New Castle; James W. Robison, Jr., Wexford, both of Pa.; James H. Young, Poland, Ohio

[73] Assignee: Reactive Metals and Alloys Corporation, West Pittsburg, Pa.

[21] Appl. No.: 548,619

[22] Filed: Jul. 5, 1990

[51] Int. Cl.[5] ..... C22C 33/08

[52] U.S. Cl. ..... 75/315

[58] Field of Search ..... 75/315, 536, 310

[56] References Cited

U.S. PATENT DOCUMENTS

| | | | |
|---|---|---|---|
| 3,801,303 | 4/1974 | Kotler | 75/315 |
| 3,929,464 | 12/1975 | Todd | 75/536 |
| 3,957,502 | 5/1976 | Cull | 75/315 |
| 3,998,625 | 12/1976 | Koros | 75/536 |
| 4,040,818 | 8/1977 | Clegg | 75/310 |
| 4,137,072 | 1/1979 | Kawakami et al. | 75/58 |
| 4,199,351 | 4/1980 | Gammal | 75/315 |
| 4,209,325 | 6/1980 | Cooper et al. | 75/58 |
| 4,279,643 | 7/1981 | Jackman | 75/58 |
| 4,364,771 | 12/1982 | Cordier et al. | 75/58 |
| 4,600,434 | 7/1986 | Kleimeyer et al. | 75/53 |
| 4,705,561 | 11/1987 | Green | 75/53 |
| 4,708,737 | 11/1987 | Skach, Jr. et al. | 75/58 |
| 4,764,211 | 8/1988 | Meichsner et al. | 75/58 |
| 4,765,830 | 8/1988 | Skach, Jr. et al. | 75/53 |

*Primary Examiner*—Peter D. Rosenberg

*Attorney, Agent, or Firm*—Buchanan Ingersoll

[57] ABSTRACT

An additive for use in the desulfurization of molten iron is disclosed. The additive comprises a granular mixture of metallic magnesium, calcium oxide and a small amount of a hydrocarbon-containing material which provides a volatile gas producing component to the mixture. The hydrocarbon-containing material is preferably coal, carbon black, wood flour or a high density polyethylene. The additive is intended to be pneumatically injected into the melt in a stream of nonoxygenated carrier gas.

26 Claims, No Drawings

IRON DESULFURIZATION ADDITIVE AND METHOD FOR INTRODUCTION INTO HOT METAL

BACKGROUND OF THE INVENTION

1. Field of the Invention

The invention relates to an additive utilized for the desulfurization of iron or blast furnace hot metal. More specifically, the additive comprises magnesium or its alloys and a hydrocarbon material having a volatile content.

2. Description of the Prior Art

In order to reduce the overall cost of steelmaking, it has become increasingly desirable to perform a desulfurization step on the hot metal between the blast furnace and the steelmaking furnace. To accomplish this desulfurization, a variety of materials and mixtures have been used. Initially, a magnesium-impregnated form of coke was used. Soon thereafter, techniques for pneumatic injection of salt-coated magnesium granules were developed.

More recently, mixtures of magnesium granules or magnesium powder with either lime-based powders or with calcium carbide-based powders have been increasingly utilized. In the case of lime-based powders, fluorspar, calcium chloride, sodium fluoride, soda ash or similar materials often are added to the mixtures to alter the physical or chemical characteristics of the slags resulting from the desulfurization treatment. Additionally, these materials might be added to provide some marginal improvement in the efficiency of the desulfurization process per unit of magnesium consumed.

U.S. Pat. No. 4,708,737 discloses an injectable magnesium or aluminum additive for use with a molten metal. The magnesium or aluminum metal is permeated into a particulate reagent of an inorganic alkaline earth material. A particulate product may be obtained and used from this material by grinding.

U.S. Pat. No. 4,364,771 teaches the use of an injectable granular additive which is introduced in a stream of carrier gas. It is comprised of a mixture of granular magnesium base shot and granular slag material.

U.S. Pat. No. 4,209,325 discloses the introduction of magnesium with a sintered mixture of lime and a fluxing agent into the melt by injection.

U.S. Pat. No. 4,764,211 discloses the use of calcium carbide and dried coal to achieve desulfurization. Magnesium is described as an optional inclusion. The patent discusses the need to adjust the percent composition of the coal based on its volatile components.

In the case of calcium carbide-containing mixtures, a quantity of gas generating material, which is usually limestone, is often included to break down agglomerations of the carbide mixture. This increases the surface area of the carbide exposed to the metal and thereby increases the portion of desulfurization accomplished by the calcium carbide relative to the metallic magnesium or magnesium alloy.

The common approach of the prior art, save for U.S. Pat. No. 4,764,211 is the introduction of an alkaline earth metal, preferably magnesium, into the melt. This must be done under such conditions that the desulfurization takes place, but that it is done safely and efficiently. The cost of magnesium is a limiting factor on its utilization in this application, and it is a specific goal in the industry to minimize its concentration in any additive mixture. One of the simplest additives utilizing magnesium is merely its addition in combination with lime, or calcium oxide. A weight percentage of 25 to 30 percent is normal in this case. Since magnesium is a gas generating material, other gas generators such as limestone are expected to be counterproductive when utilized with lime-magnesium mixtures. Small amounts of fluorspar may be utilized to achieve a more liquid slag, but this is considered optional.

It has been disclosed that the use of natural gas as a transport medium in steel desulfurization slightly improves the efficiency of magnesium utilization, and thereby lowers the costs of sulfur removal. To explain the improved magnesium efficiency, it has been theorized that the improvement must result from the presence of carbon in the carrying gas. When injected into liquid steel, methane or natural gas decomposes into elemental carbon, which is not recognized as a desulfurizer. Hydrogen gas, which is also not recognized as a desulfurizer in these systems, is another product.

The volume of hydrogen gas generated would be twice the volume of natural gas injected, but the volume of natural gas required for powder transport is lower than in the case of transport with nitrogen or argon, because of differences in viscosity. These effects offset each other, so natural gas injection results in only slightly more gas volume, creating only slightly more turbulence in the ladle than injection with nitrogen or argon gases. Natural gas and similar combustible gases, however, present serious safety problems when used as the conveying medium.

What is lacking in the art, therefore, is an additive which will achieve improved desulfurization of molten iron through more efficient gas generation to reduce the amount of magnesium required for the task. The additive must be safe to use, in that it cannot be explosive, and easily manufactured and transported

SUMMARY OF THE INVENTION

An additive for use in the desulfurization of molten iron is disclosed. The additive preferably comprises magnesium, calcium oxide and a hydrocarbon containing compound. Fluorspar or dolomitic lime may optionally be added to control the physical characteristics of the resulting slag.

The additive is intended to introduce magnesium-lime mixture into the melt for its desulfurization capabilities. These capabilities are enhanced by the inclusion of a gas-generating hydrocarbon-containing constituent. In the melt, the magnesium-lime mixture tends to form agglomerations. The hydrocarbon constituent improves the desulfurization of the magnesium-lime mixture by increasing the surface area of the magnesium-lime agglomerations. At the high operating temperatures found in iron-melting, the hydrocarbon constituent forms a gas which breaks down the magnesium-lime agglomerations. This is performed internally to the magnesium-lime agglomeration.

These and other advantages and features of the present invention will be more fully understood with reference to the presently preferred embodiments thereof.

DESCRIPTION OF THE PREFERRED EMBODIMENTS

The disclosed alloy additive is comprised of magnesium, calcium oxide or lime, fluorspar if required for a specific application, and a hydrocarbon substance. The additive is granular and preferably sized to allow good surface area contact with the melt, but large enough to avoid the fire hazards and explosive characteristics of extremely fine grained materials.

The magnesium content is provided by granular or powdered magnesium metal, which is generally between 0.003 and 0.06 inches, or 14 to 200 U.S. standard mesh. The magnesium content of the final mixture is generally between 10 and 40 percent, and is preferably between 22 and 30 percent.

Fluorspar or dolomitic lime are commonly added to change the physical characteristics of the resulting slag formed by the hot metal to which the mixture is added. Granular fluorspar, which increases the fluidity of the slag, may comprise up to 10 percent of the mixture. Dolomitic lime increases the stiffness of the slag, and may comprise up to 40 percent of the mixture. Both are preferably within the size constraints given above.

The hydrocarbon component of the mixture generally comprises between one-quarter of one percent and eight percent of the mixture, depending on the material utilized and its volatile content. Expressed in terms of volatile content, the final mixture is generally between one quarter and five percent volatiles, and preferably contains one percent volatiles. While the hydrocarbon component may be any hydrocarbon-containing material, it is preferably a carbonaceous solid fuel, a cellulose material or a resin-based plastic. Non-halogenated hydrocarbon plastics are specifically recommended. Specific examples of these hydrocarbon materials are pulverized coal, petroleum coke and carbon black; wood flour, cellulose plastic and paper; and certain high density polyethylenes, respectively. While a very broad range of materials may be utilized from a technical standpoint, the preferred materials are selected based on environmental constraints and the presence of deleterious materials therein. An example of this is sulfur, which is found in polysulfone plastics. The preferred materials are described more fully below.

If pulverized coal is to be utilized, it must be noted that coals have a wide variety of volatile contents. The volatile content of the coal to be utilized must be determined before manufacture of the additive. The amount of coal is selected such that the final mixture comprises between one quarter and five percent volatiles. An example of this is coal having 25 percent volatile content. The mixture would then comprise three percent coal. It should also be noted that the coal should be pulverized to a mesh size consistent with the other components of the mixture.

Wood flour, which is commercially available as a waste product, is generally of the correct sizing to allow its incorporation into the mixture without further size processing. When wood flour is utilized as the hydrocarbon containing element, it generally comprises one percent of the mixture.

Carbon black is also commercially available in the correct size range, and generally comprises 11 percent volatile matter. When utilized in the mixture, it generally comprises six percent of the mixture.

High density polyethylenes may also be utilized as the hydrocarbon containing component. These materials are generally 100 percent volatile matter. The plastic material is crushed or ground into particulate matter which is generally within the size range given above. The material comprises approximately one percent of the mixture.

As the experimental additives have great variation in chemical composition, density, volatile matter (from 11% to 100%), and structure, there is reason to believe that other related materials such as cellulose, found in such materials as wood fibers or wood flour; rubber; wax; paraffin; petroleum coke and the like; would offer advantages similar to those demonstrated for coal, carbon black and the polyethylenes. As many of these materials are waste products of manufacturing operations, and as many of these materials are difficult to economically recycle or offer disposal problems, they are available in large quantities at a low cost. Magnesium, on the other hand, is costly, easily recyclable, and has a high energy cost per pound. Therefore, this invention reduces the consumption of a valuable, energy-intensive material, magnesium, while consuming low-energy content, low-value materials, some of which materials may be environmental nuisances.

It should be specifically noted that the percentage composition of the mixture is determined by weight. Additionally, the amount of hydrocarbon containing material contained in the mixture is primarily controlled by the volatiles content of the specific material utilized. The weight percentages given for the specific examples of the hydrocarbon containing elements are to be considered general targets, and not limitations on their addition.

The balance of the mixture, which is typically 60 to 80 percent, is calcium oxide. The lime should be crushed to a size consistent with the other elements of the mixture, to obtain a granular mixture having generally equally sized granules. This increases the flowability of the material. A small amount of a silicone compound or other "flow aid" may optionally be added to the finished mixture to further increase the flowability of the dry powder.

A number of methods are utilized to form the additives. A mixture containing metallic magnesium may be prepared in a variety of ways, including mechanical blending, impregnation of liquid magnesium into a porous solid followed by comminution and the like. The preferred method of manufacture is by mechanical blending of the constituent materials.

The material may be introduced into the hot metal by any one of a number of well-known techniques, but is preferably introduced by pneumatic injection. Bulk addition of the material to the melt is not recommended, especially utilizing the polyethylene embodiment, as the plastic material would merely vaporize.

The additive is conventionally introduced into the melt in a stream of carrier gas. The carrier gas is preferably nonoxidizing, being either inert or reducing. Specific carrier gases which are recommended for this use are nitrogen or argon.

The additive is introduced in a quantity based on the desulfurization required. The specific amounts of material to be added to the melt, therefore, cannot be predicted without knowledge of the parameters of the desulfurization to be performed. Each addition must be done on a case by case basis. It is intended, however, that the use of this mixture enjoys a savings of approximately ten percent over the prior art additives described below in the examples This permits an approximation to be made for the addition of 90 percent of the prior art materials to achieve a predictable level of desulfurization.

Three examples follow to illustrate the advantages of the additive. Each compares a prior art mixture of 25 to 30 percent magnesium, with the balance of the additive being lime. Fluorspar may be present, but is not considered to be chemically relevant to the desulfurization.

In normal industrial practice, blast furnace hot metal is desulfurized by injecting a quantity of the lime-magnesium reagent into the hot metal. The quantity of the reagent to be injected is determined by the initial sulfur content of the metal and the final sulfur content desired. This is calculated through the use of an equation or a chart based upon historical data. To determine the effect of our additions on reagent performance, the amount of reagent to be injected was reduced by a known percentage from that required by the "shooting chart" or equation.

EXAMPLE 1

Heats of blast furnace hot metal were desulfurized with lime-magnesium mixtures containing four percent and six percent bituminous coal, having approximately 32% volatile matter, as −20 U.S. standard mesh granules This series of heats was compared with standard operations using a lime-magnesium mixture containing the standard level of magnesium. The sizing of the lime and magnesium and operating parameters such as mass flow rates and gas flows were kept nearly constant. The mixes with coal reduced the consumption of magnesium by at least ten percent compared to lime-magnesium mixes without coal as an additive, for the same level of desulfurization. In addition to reducing the specific consumption of magnesium, the coal-containing heats had shorter injection times, which increases tonnage capacities; less refractory wear and longer lance life.

| WEIGHT (100,000's) | START SULFUR | END SULFUR | AIM SULFUR | PERCENT REDUCTION |
|---|---|---|---|---|
| 499 | 0.0290 | 0.0058 | 0.0100 | 11.8 |
| 477 | 0.0330 | 0.0089 | 0.0100 | 15.7 |
| 504 | 0.0360 | 0.0051 | 0.0050 | 15.7 |
| 506 | 0.0610 | 0.0030 | 0.0120 | 15.4 |
| 489 | 0.0340 | 0.0024 | 0.0030 | 11.5 |
| 490 | 0.0270 | 0.0081 | 0.0050 | 19.3 |

The average reduction from the prior art additive in the above example is 14.9 percent.

EXAMPLE 2

A series of heats of blast furnace hot metal was desulfurized using a mixture of lime-magnesium containing 0.6% by weight or 1.0% by weight of high-density polyethylene. These heats were compared to normal practice using the standard lime-magnesium mixture. The heats treated with the mixes containing polyethylene generally required 22% less magnesium for the same level of desulfurization Injection times were shorter for the mixes with polyethylene compared to the standard lime-magnesium mixture, and refractory erosion was reduced with the polyethylene-containing mixes.

| WEIGHT (100,000's) | START SULFUR | END SULFUR | AIM SULFUR | PERCENT REDUCTION |
|---|---|---|---|---|
| 491 | 0.0390 | 0.0087 | 0.0100 | 10.8 |
| 500 | 0.0470 | 0.0054 | 0.0100 | 15.9 |
| 507 | 0.0490 | 0.0044 | 0.0100 | 11.1 |
| 500 | 0.0370 | 0.0082 | 0.0070 | 19.7 |
| 500 | 0.0830 | 0.0085 | 0.0070 | 23.4 |
| 515 | 0.0600 | 0.0120 | 0.0070 | 25.4 |

-continued

| WEIGHT (100,000's) | START SULFUR | END SULFUR | AIM SULFUR | PERCENT REDUCTION |
|---|---|---|---|---|
| 496 | 0.0330 | 0.0065 | 0.0070 | 16.7 |

The average reduction from the prior art additive in the above example is 17.6 percent.

EXAMPLE 3

A series of heats of blast furnace hot metal was desulfurized using a mixture of lime-magnesium containing four to six weight percent carbon black, having approximately 11% volatile matter. These heats were compared to normal practice using the lime-magnesium mixture. The heats treated with the mixture containing carbon black required 12% less magnesium for the same level of desulfurization than the standard mixture without carbon black.

| WEIGHT (100,000's) | START SULFUR | END SULFUR | AIM SULFUR | PERCENT REDUCTION |
|---|---|---|---|---|
| 516 | 0.0420 | 0.0087 | 0.0070 | 11.6 |
| 510 | 0.0290 | 0.0041 | 0.0070 | 11.6 |
| 481 | 0.0230 | 0.0107 | 0.0100 | 11.9 |
| 487 | 0.0270 | 0.0049 | 0.0030 | 11.6 |
| 490 | 0.0340 | 0.0034 | 0.0130 | 11.4 |
| 500 | 0.0330 | 0.0083 | 0.0070 | 12.4 |
| 496 | 0.0310 | 0.0068 | 0.0070 | 11.8 |
| 503 | 0.0400 | 0.0057 | 0.0070 | 11.3 |
| 503 | 0.0420 | 0.0068 | 0.0050 | 11.6 |

The average reduction from the prior art additive in the above example is 11.7 percent.

While we have described a present preferred embodiment of the invention, it is to be distinctly understood that the invention is not limited thereto but may be otherwise embodied and practiced within the scope of the following claims.

We claim:

1. An additive for desulfurization of liquid iron and iron alloys, comprising:

calcium oxide;

magnesium; and a hydrocarbon-containing material which contributes volatile material to the additive, such that the volatile content of the additive is between 0.25 and 5 percent.

2. An additive as described in claim 1, further comprising a component adapted to alter the physical characteristics of slag formed from the liquid iron or iron alloys

3. An additive as described in claim 2, wherein the component is selected from the group consisting of fluorspar and dolomitic lime.

4. An additive as described in claim 3, comprising up to 10 percent fluorspar.

5. An additive as described in claim 3, comprising up to 40 percent dolomitic lime.

6. An additive as described in claim 1, wherein the additive is granular.

7. An additive as described in claim 6, wherein the granular additive is sized between 14 and 200 U.S. standard mesh.

8. An additive as described in claim 1, wherein the magnesium content is between 10 and 40 percent.

9. An additive as described in claim 8, wherein the magnesium content is between 22 and 30 percent.

10. An additive as described in claim 1, wherein the hydrocarbon component of the additive comprises between one quarter of on weight percent and eight weight percent.

11. An additive as described in claim 1, wherein the additive contains one percent volatiles.

12. An additive as described in claim 1, wherein the hydrocarbon component is a carbonaceous solid fuel.

13. An additive as described in claim 12, wherein the carbonaceous solid fuel is selected from the group consisting of coal, petroleum coke and carbon black.

14. An additive as described in claim 13, wherein the carbonaceous solid fuel is coal and wherein the coal comprises three weight percent of the additive.

15. An additive as described in claim 13, wherein the carbonaceous solid fuel is carbon black and wherein the carbon black comprises six weight percent of the additive.

16. An additive as described in claim 1, wherein the hydrocarbon component is a cellulose-based material.

17. An additive as described in claim 16, wherein the cellulose-based material is selected from the group consisting of wood flour, cellulose plastic and paper.

18. An additive as described in claim 17, wherein the cellulose-based material is wood flour and wherein the wood flour comprises one weight percent of the additive.

19. An additive as described in claim 1, wherein the hydrocarbon component is a plastic material.

20. An additive as described in claim 19, wherein the plastic material is non-halogenated.

21. An additive as described in claim 20, wherein the non-halogenated plastic material is a high density polyethylene.

22. An additive as described in claim 21, wherein the high density polyethylene comprises one weight percent of the additive.

23. A method for introducing a desulfurizing additive comprising calcium oxide, magnesium and a hydrocarbon to liquid iron and iron alloys, in which the additive is introduced to the liquid in a stream of non-oxidizing carrier gas.

24. A method for introducing an additive to a liquid as described in claim 23, wherein the carrier gas is inert.

25. A method for introducing an additive to a liquid as described in claim 23, wherein the carrier gas is a reducing gas.

26. A method for introducing an additive to a liquid as described in claim 23, wherein the carrier gas is selected from the group comprising nitrogen or argon.

* * * * *

UNITED STATES PATENT AND TRADEMARK OFFICE

CERTIFICATE OF CORRECTION

PATENT NO. : 5,021,086

DATED : June 4, 1991

INVENTOR(S) : LEON A. LUYCKX, JOSEPH R. JACKMAN, JAMES W. ROBISON, JR., JAMES H. YOUNG

It is certified that error appears in the above-identified patent and that said Letters Patent is hereby corrected as shown below:

On the title page:

At [19], United States Patent, change "Luydkx" to --Luyckx--.

At [75], Inventors, change "Luydkx" to --Luyckx--.

Signed and Sealed this

Twenty-second Day of September, 1992

*Attest:*

DOUGLAS B. COMER

*Attesting Officer*

*Acting Commissioner of Patents and Trademarks*